US006966439B2

(12) United States Patent
Weleczki

(10) Patent No.: US 6,966,439 B2
(45) Date of Patent: Nov. 22, 2005

(54) MULTIPURPOSE UNIVERSAL CARRYING BAG

(76) Inventor: Alan M. Weleczki, 4219 W. 44th St., Edina, MN (US) 55424

( * ) Notice: Subject to any disclaimer, the term of this patent is extended or adjusted under 35 U.S.C. 154(b) by 174 days.

(21) Appl. No.: 10/389,197

(22) Filed: Mar. 14, 2003

(65) Prior Publication Data

US 2003/0223651 A1 Dec. 4, 2003

Related U.S. Application Data

(60) Provisional application No. 60/364,755, filed on Mar. 15, 2002.

(51) Int. Cl.[7] ..... A63B 55/02

(52) U.S. Cl. ..... 206/315.3; 190/107; 206/315.2; 206/315.6; 206/315.8; 383/2

(58) Field of Search ..... 190/107; 206/315.3, 206/315.2, 315.1, 315.6, 315.11; 383/2

(56) References Cited

U.S. PATENT DOCUMENTS 1,636,194 A * 7/1927 Thomas ..... 224/579
1,920,308 A * 8/1933 Hiles ..... 206/315.6
2,009,072 A * 7/1935 Sampson ..... 206/315.4
2,010,166 A * 8/1935 Thompson ..... 206/315.6
2,023,792 A * 12/1935 Sampson ..... 206/315.4
3,033,259 A * 5/1962 Landis, Sr. ..... 206/315.11
4,182,391 A * 1/1980 Kjose ..... 224/581
4,951,816 A * 8/1990 Smith ..... 206/279
5,131,513 A * 7/1992 Gossage ..... 190/107
5,469,967 A * 11/1995 Boorady ..... 206/527
6,250,470 B1 * 6/2001 Mackenzie ..... 206/579
6,789,713 B1 * 9/2004 Redzisz ..... 224/578

* cited by examiner

*Primary Examiner*—Tri M. Mai
(74) *Attorney, Agent, or Firm*—Westman, Champlin & Kelly, P.A.

(57) ABSTRACT

A multipurpose carrying bag folds in different formats for holding different size and shapes of objects, and includes a variety of pockets and fasteners for holding various things, primarily related to golfing or sporting equipment. The bag can be used as an open top golf bag, or it can be folded longitudinally with closed ends for use as a carry-on or support bag.

14 Claims, 8 Drawing Sheets

MULTIPURPOSE UNIVERSAL CARRYING BAG

CROSS-REFERENCE TO RELATED APPLICATION

The present application is based on claims the benefit of U.S. Provisional Patent Application Ser. No. 60/364,755, filed Mar. 15, 2002, the content of which is hereby incorporated by reference in its entirety.

BACKGROUND OF THE INVENTION

The invention relates to a multipurpose carrying bag that folds in different formats for holding different size and shapes of objects, and includes a variety of pockets and fasteners for holding various things, primarily related to golfing, sporting equipment and the like. The bag can be used as an open top golf bag; it can be a folded carry-on travel bag; or form an elongated carry-on travel bag by proper folding.

Various sports bags have been utilized in the past, but they usually have a single purpose. These prior art bags in many cases do fold much like a suit bag, but a conversion from one use to another, by folding and appropriately fastening the individual bag sections provide for a highly universal sports bag used as a carry-on travel bag, golf bag, and similar purposes.

SUMMARY OF THE INVENTION

The present invention relates to a bag that is suitably dimensioned to accomplish the purpose of carrying varying sports items, and it comprises a flexible material panel, such as a fabric, that has an outer perimeter defining an interior space. The panel has sections that are joined together, end to end. The panel forming the bag is divided into a center section and end sections that are arranged sequentially in a series along a longitudinal direction. The panels can be left flat or folded so the bag is full length, two thirds length or about a third of the panel length (the length of the center section), if desired. Fasteners, such as a zipper, snaps, hook and loop fastener or the like extend around at least one end and along a pair of the longitudinally extending sides of the fabric panel, so that upon folding the panel upon a longitudinal dividing line, that is dividing the panel in a longitudinal direction, the fastener or zipper can be closed and the elongated bag can be formed. At least one of the end sections is foldable to overlie portions of the center section so that the zipper or fastener can close to form an open-top relatively elongated bag.

Various pockets that are accessible when the bag is folded, are provided.

The first and second end sections will both fold over the center section, and this reduces the longitudinal length. The bag is again foldable along the longitudinal axis or line so that the longitudinal side edges of the panel mate and fasteners will hold the panel in the position so that it becomes a relatively small carry-on travel bag.

The bag is reversible, that is, the side that can be normally termed the inside can be become the outside when being used as a golf bag, and then for travel, a smooth exterior can be provided. The compartments are fully enclosed by zippers.

The bag can be made of any suitable, durable fabric, and is easily constructed and highly universal in its use. Preferably, the panel is made of two layers of fabric of different colors. Two exterior colors can be provided when the panel is folded to expose a different side of the panel.

DESCRIPTION OF THE ILLUSTRATIVE EMBODIMENTS

Figure 1:
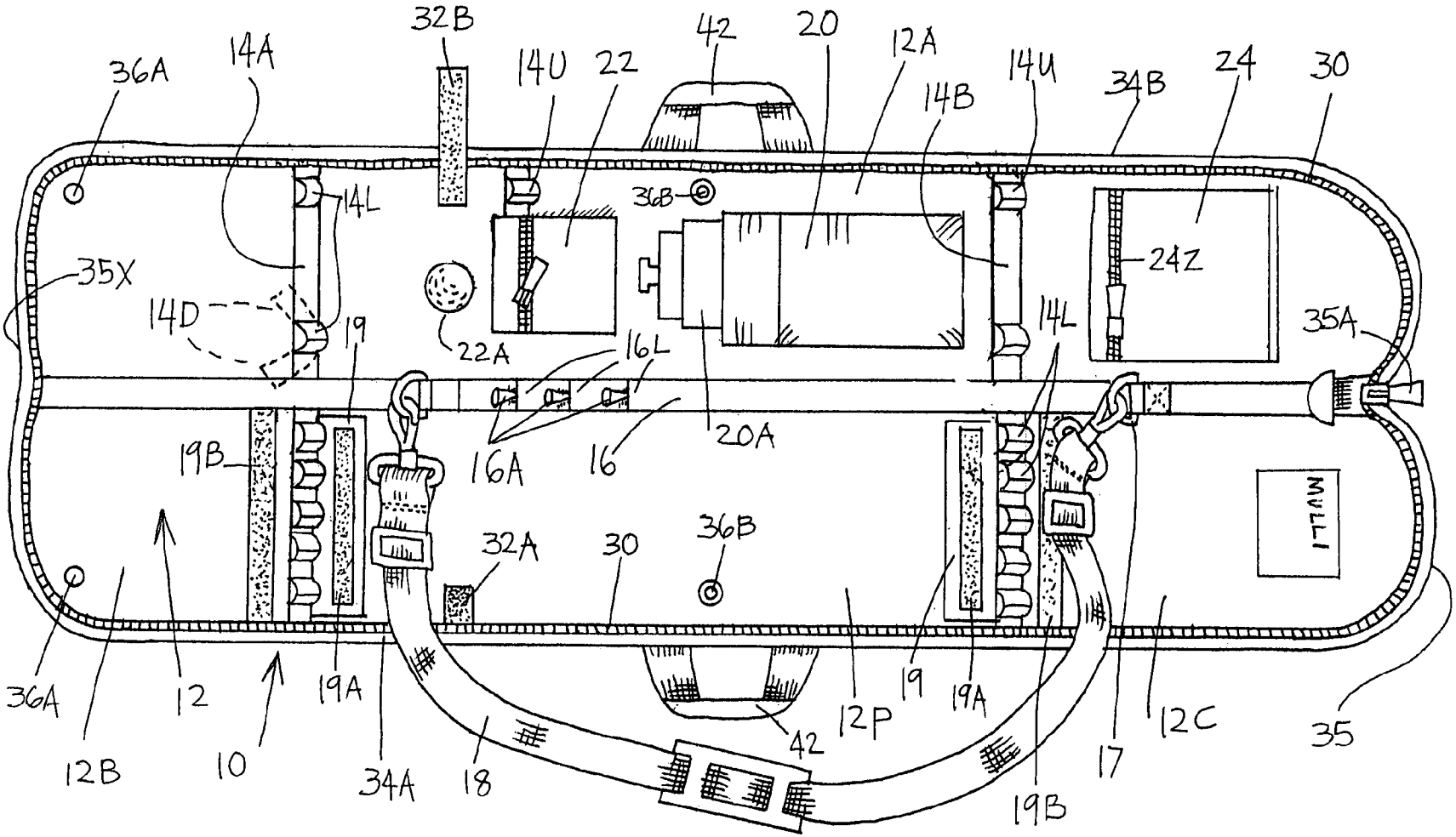
FIG. 1 is a flat layout of a fabric panel for forming the bag of the present invention showing one side thereof.
Figure 2:
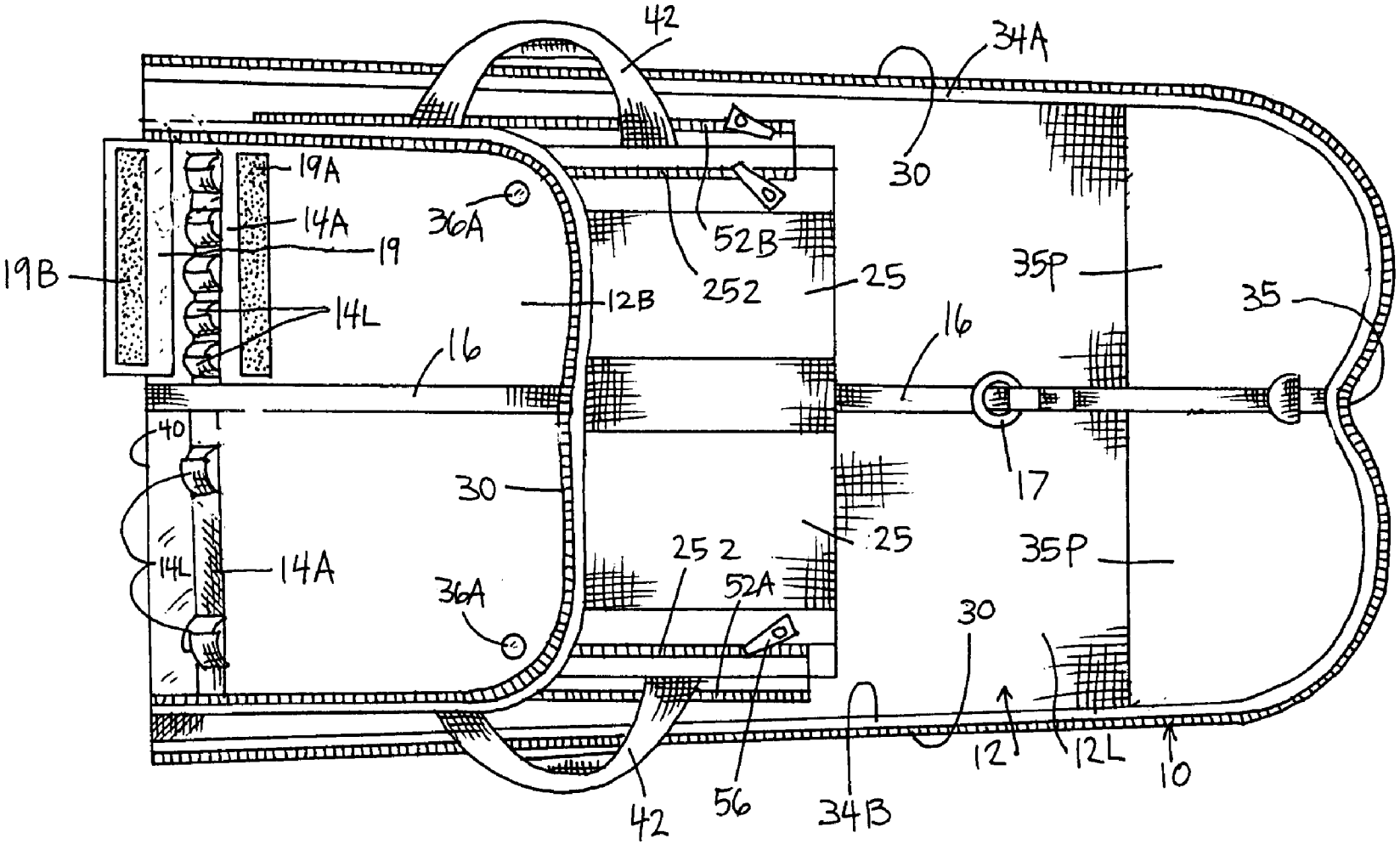
FIG. 2 is a layout of an opposite side of the bag of FIG. 1 with one end of the bag folded back upon itself.

Referring to FIGS. 1 and 2, in particular, a bag 10 made according to the present invention shown is made of a fabric body 12 that has two fabric or flexible material layers that form a single panel. The layers can be different color or texture so the bag is reversible with a different color showing when reversed. Padding can be placed between the layers if desired. The panel can be a single thickness of one material if desired. The bag 10 is reversible and is foldable along a longitudinal center seam reinforcing strap 16 and then closed on selected sides to form an interior chamber. The bag is made into three distinct sections along the length of the bag, including a center section 12A, a first end section 12B, and a second end section 12C. These bag sections are generally defined with transverse fabric enforcing tape or strapping shown at 14A and 14B, respectively, and the bag is reinforced with the longitudinally extending center seam strap of suitable material show at 16. The strap 16 can have D rings 17 thereon, as shown, on both sides of the panel, as shown in FIG. 2 as well, to provide for snapping on a shoulder strap 18. The fabric can be rip-stop nylon or other durable, flexible materials or fabrics. The reinforcing straps also can be conventional material such as nylon. The term "fabric" is intended to mean a flexible material that can be stretched or sewn and includes artificial and real synthetics and leathers. One layer of the panel of material 12 is shown in FIG. 11 at 12P and the second layer is shown in FIG. 2 at 12L.

The center section 12A of the bag 10 has suitable pockets formed thereon. For example, a water bottle pocket 20 and a golf ball pocket 22 can be provided on one side of the bag, and an auxiliary pocket 24 can be provided as shown on second end section 12C for carrying gloves, towels, or similar items. As can be seen, the pockets are patches of material sewn in place. Flaps or zippers can be provided to cover open ends of the pockets, or they can be left open.

Also, a flap 19 can be used to cover some of loops 141, as shown in FIGS. 1 and 2 on panel section 12B. The flap 19 is held with hook and loop strips 19A and 19B.

Figure 6:
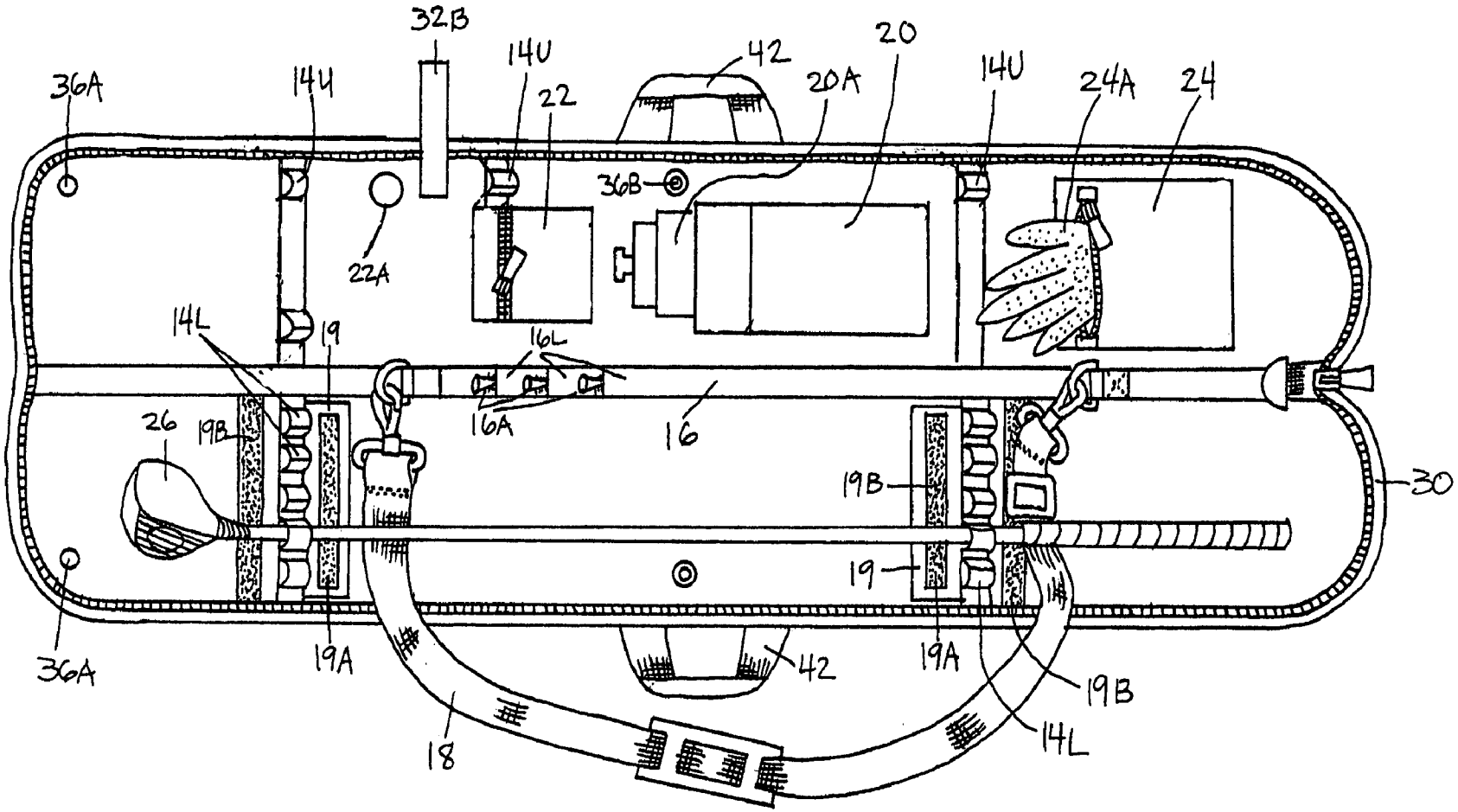
FIG. 6 is a view similar to FIG. 1, showing objects in loops and carrying pockets of the bag.

The transverse or cross straps 14A and 14B, have openable and closeable loops 141 formed in them, which can be used to hold elongated objects such as a golf club, in a manner that is shown in FIG. 6. These can be formed by strap sections of material having hook and loop fasteners to hold the sections closed in loops. The open strap sections are represented in dotted lines at 14D in FIG. 1. An overlying strap can be placed over such objects and also fastened with hook and loop fasteners to secure the objects in place. In FIG. 6, which is similar to the showing in FIG. 1, the water bottle pocket 20 has a water bottle 20A in it; the golf ball pocket 22 is not shown with golf balls in it, but golf balls 22 is shown adjacent pocket 22; and gloves are shown at 24A in FIG. 6 for insertion into the pocket 24. Pocket 24 has a zipper closure 24Z.

In FIG. 6, golf club 26 is shown being held in loops 14L on straps 14A and 14B. Separate strap sections overlying the straps 14A and 14B can be held in loop form with hook and loop fasteners sold under the trademark Velcro® or snaps or the like. Additionally, the center strap 16 can have loops or pockets 16L to hold golf tees shown at 16A. Suitable other holders, loops, pockets or the like can be provided.

Figure 3:
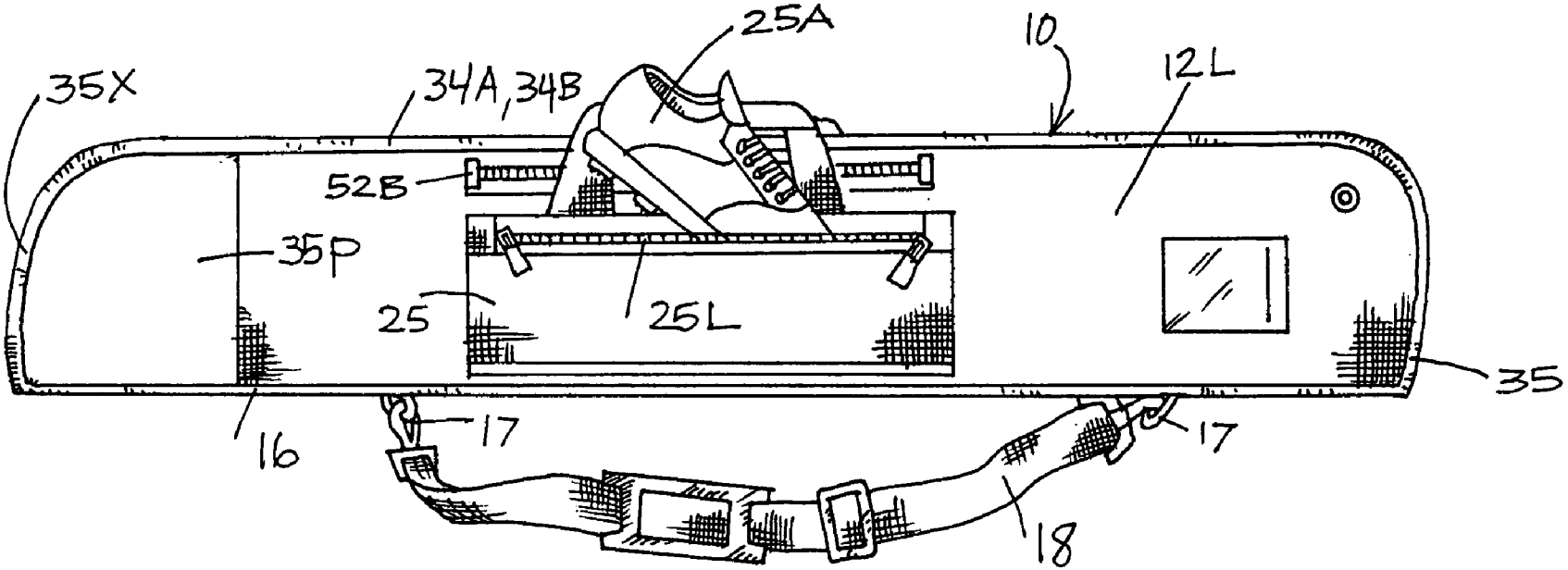
FIG. 3 is a view of a first format of a bag formed with the fabric panel left full length to provide a long travel bag.

A fastener arrangement comprising a zipper 30 is provided along the longitudinal edges 34A and 34B, and the zipper extends along a base end 35. This zipper starts at junction 35A at the base end 35 and can be used when the bag is folded in half longitudinally, or in other words, folded along a central longitudinal axis so the longitudinal half sections of the bag overlie each other and strap 16 is at one edge. The bag 10 then can be zipped or fastened closed and left full length. This is shown as the first format forming a full length bag 10 in FIG. 3. The zipper 30 completely encloses the open edges and for example, golf clubs can be enclosed in the bag for travel. The zipper will close end 35 and can extend to zip closed at the opposite end 35X or the end 35X can be left open. Protective end panels 35P of synthetic leather can be placed on the outer panel 122. Also, as shown in FIG. 3, shoe pockets 25 can be provided on both of the sides of the bag forming the outer sides of the bag when folded as shown in FIG. 3. The pockets 25 have zipper closures 25Z and will hold a shoe 25A. The pockets are also seen in FIG. 2.

If desired, one end section 12B can be folded onto the center section 12A as shown in FIG. 2 and then the two longitudinal halves are folded along center strap 16 and the open edge closed with zipper 30. FIG. 2 is the opposite side of the bag 10 from FIG. 1, that is, FIG. 2 shows the panel fabric side 12P with the pockets 20, 22 and 24 facing down. The end section 12B is folded over the surface of the center section 12A when the bag is folded with strap 16 and pockets 20, 22 and 24 on the exterior.

Figure 4:
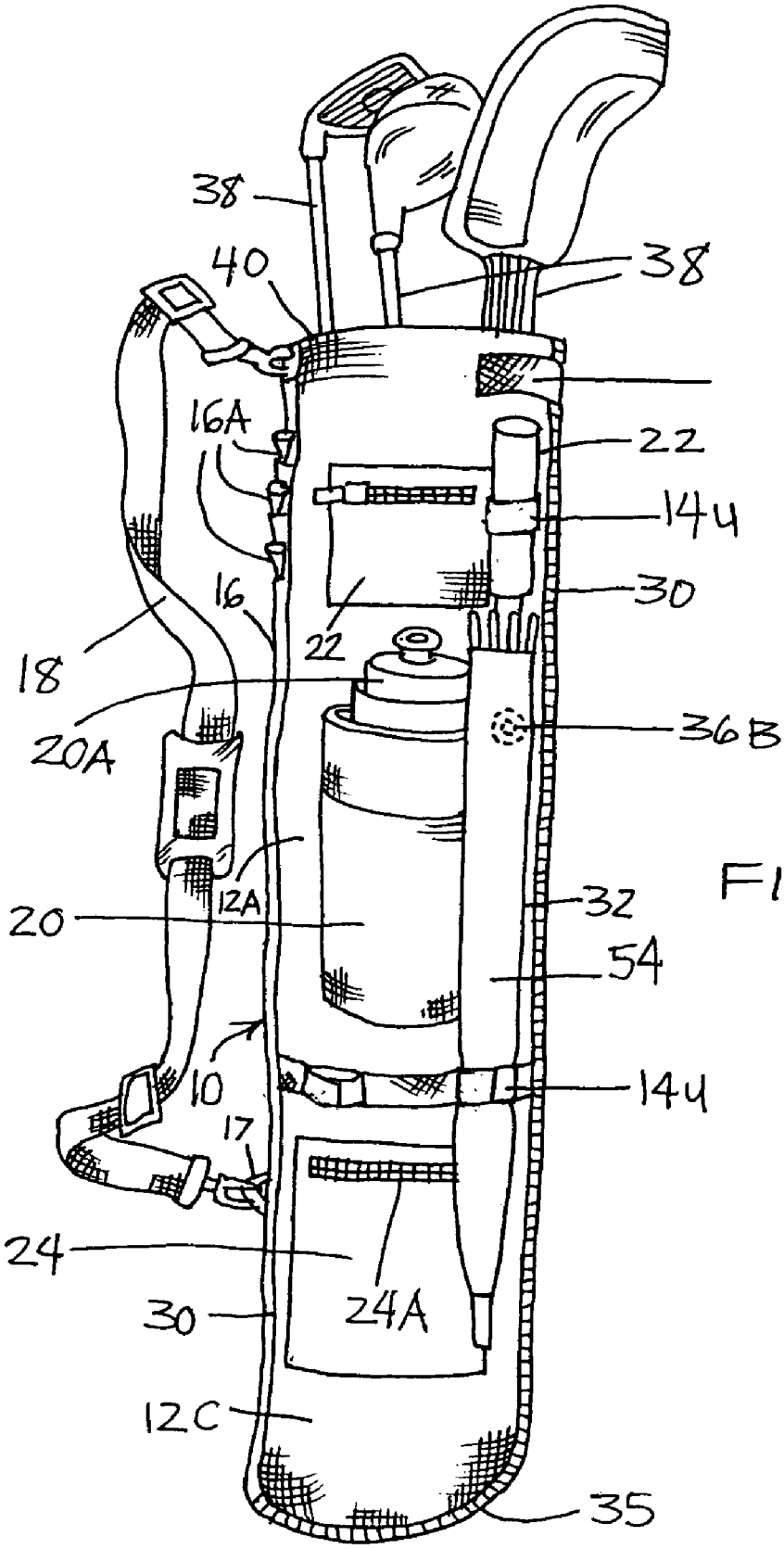
FIG. 4 is a view of the bag being used as a golf carrying bag with the pockets shown in FIG. 1 to the exterior, and made with the bag having one end folded as shown in FIG. 2.

In FIG. 4, the shoulder strap 18 is shown. An extra securing strap is shown in FIG. 1 at 32A and 32B. These sections will mate to hold the longitudinal edges of the panel together. Hook and loop fasteners sold under the trademark VELCRO®, or other securing devices can be used or strips section 32A and 32B, and also for holding a golf club in place in the loops 14L formed on the strap 14A.

Snaps 36A and 36B shown in the figures can be used at the outer corners of the end section 12B to snap it into place on center section 12A when the section 12B is folded onto the center section of the bag. The snap parts 36A and 36B are provided on both sides of the bag so the section 12B can be folded in either direction.

The end section 12B is shown folded over the side of the bag opposite from the pockets 20 and 22. The bag then is folded longitudinally along strap 16 with the strap on an outer longitudinal edge of the closed bag and section 12B is on the interior. Zipper 30 is zipped to close the base end 35 and join the edges 34A and 34B opposite from strap 16 to form an open top golf bag in the form shown in FIG. 4.

Golf clubs 38 are shown with the heads protruding out of the formed bag. The zipper 30 would be zipped up all along the longitudinal side edges 34A and 34B, but in this case, since the end bag section 12B is folded to the side shown in FIG. 2, the side shown in FIG. 2 forms the interior of the bag and the side surfaces of panel 12P of sections 12A and 12C shown in FIG. 1 are on the exterior. The material color of panel 12P is showing on the outside. Pockets 20, 22 and 24 are accessible, and the golf tees 16A in loops or pockets 16L are also accessible.

In other words, when the zipper 30 is closed as shown in FIG. 4, the bag 10 would be open top, and the end section 12B is at the open end, but folded into the center and is inside the bag. The golf clubs 38 could be placed in the bag 10 and held in the bag because the zipper 30 closes the base end 35 of the bag, and the zipper will be used to close the open vertical edges up to a junction line or top line shown at 40. The golf clubs do not have to be secured because they would be removed for play. The clubs can be held in openable and closeable loops 14L on strap 14B, if desired for transport. The D rings 17 for shoulder carrying strap 18 are exposed, so the strap 18 can be snapped in place and used for carrying the bag. The golf ball pocket 22 is shown in FIG. 4, as is the water bottle pocket 20 and the water bottle 20A. The glove/towel pocket is shown at 24, as well and it can be seen that the glove pocket can have a zipper 24Z at its top edge.

This is a second form or format of the bag 10 that can be made from the present invention. If desired, the strap sections 32A and 32B on opposite edges 34A and 34B can be hook and loop fasteners used to hold the bag sides together when it is folded.

The bag 10 also can be folded in the opposite direction from that shown in FIG. 4, where the zipper 30 (or strap fasteners 32A, 32B) would be used to close the bag with the end member 12B also folded in an opposite direction and kept to the interior, so the color of surface of panel 12L would be showing as in FIG. 3. The bag 10 would be shorter, since section 12B would be folded in. The center section 12A, and the end section 12C, would form the bag length. Handles 42 would be used for carrying the bag.

Figure 7:
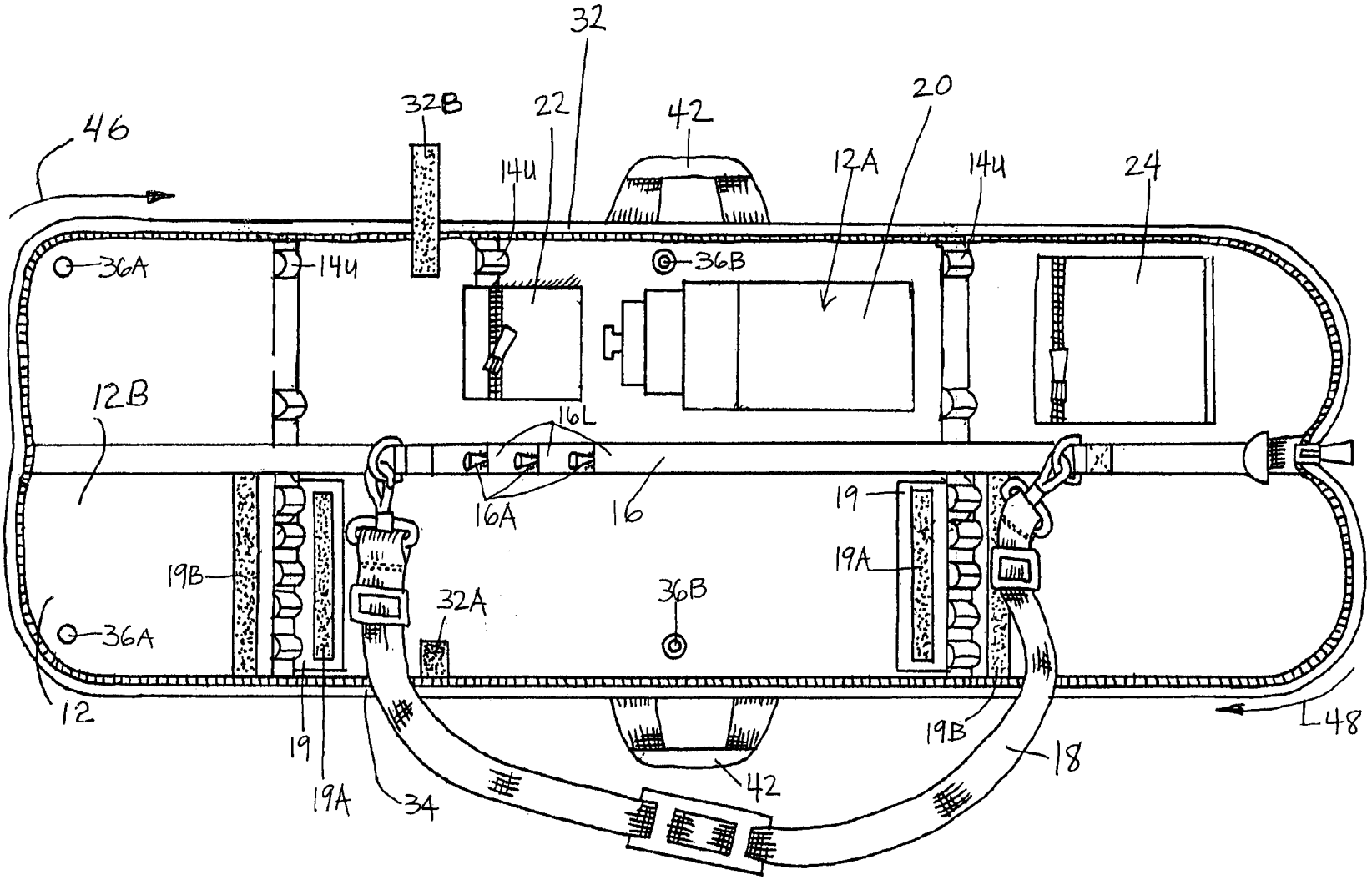
FIG. 7 is a view similar to FIG. 1, with arrows showing a sequence of folding both end sections over the center section.
Figure 8:
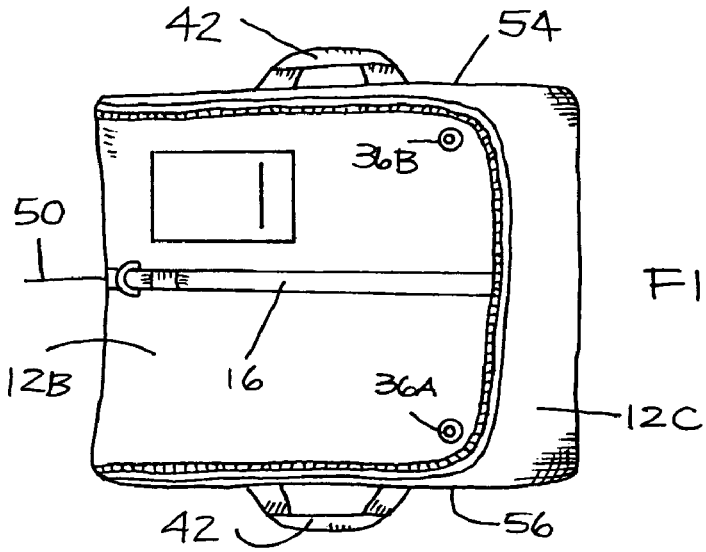
FIG. 8 is a view of the bag similar to FIG. 5 in a fully folded position with both ends folded into the middle.

As shown in FIG. 7, the end section 12B can be folded up as indicated by the arrow 46, which is opposite direction from that shown in FIG. 2, so end section 12B overlies the side with pockets 20 and 22. The same longitudinal bag length is left uncovered on the center section 12A of the bag as shown in FIG. 1, and then the other end section 12C can be folded over the remaining part of the center section 12A and section 12B, as indicated by arrow 48, either before or after the section 12B is folded. The end section 12B and 12C overlap over the center section 12A when folded. If the end section 12C is folded in first, and the section 12B is folded in second, it will have the configuration shown in FIG. 8.

Figure 5:
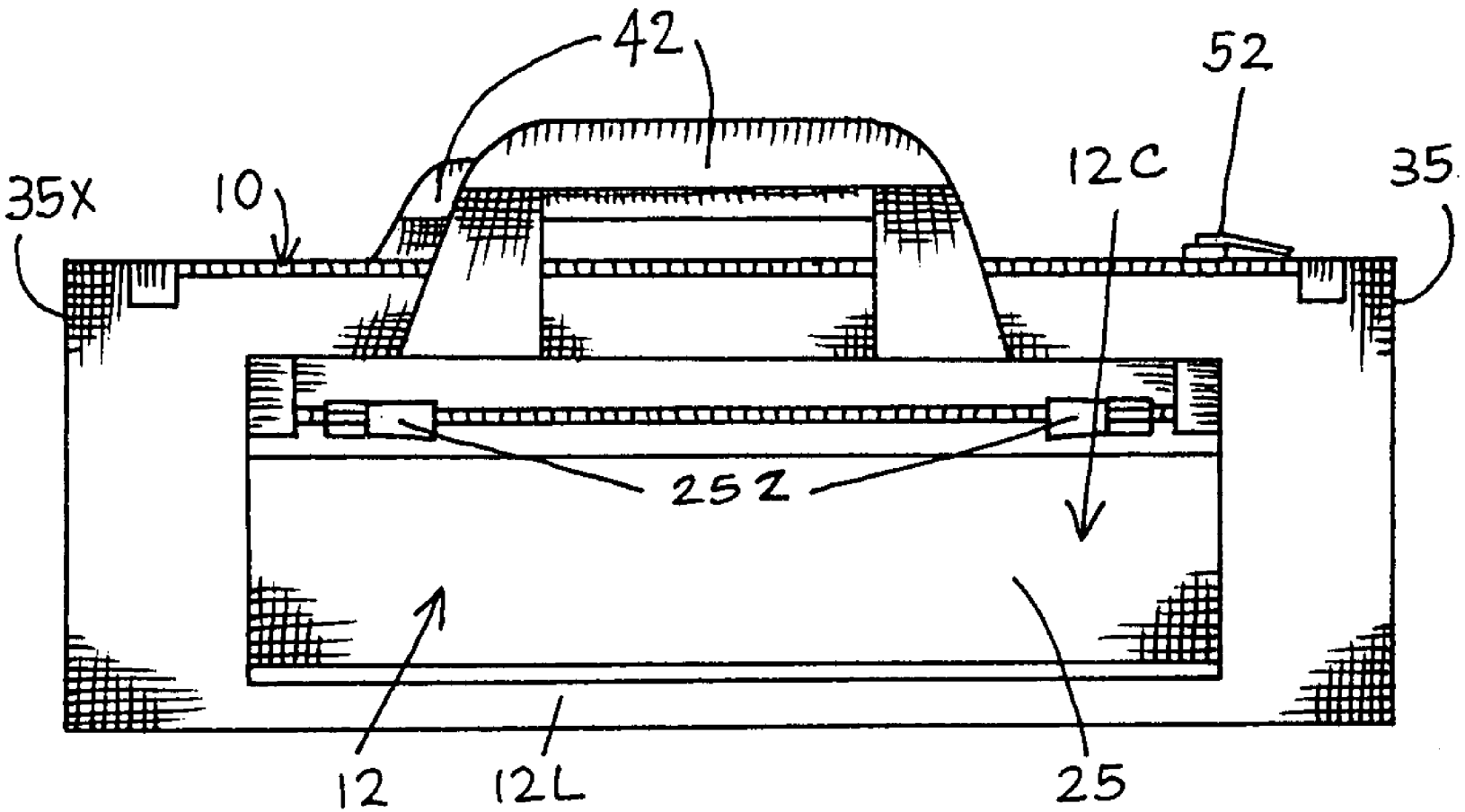
FIG. 5 is a side view a second format of the bag in a shortened fully folded form.
Figure 9:
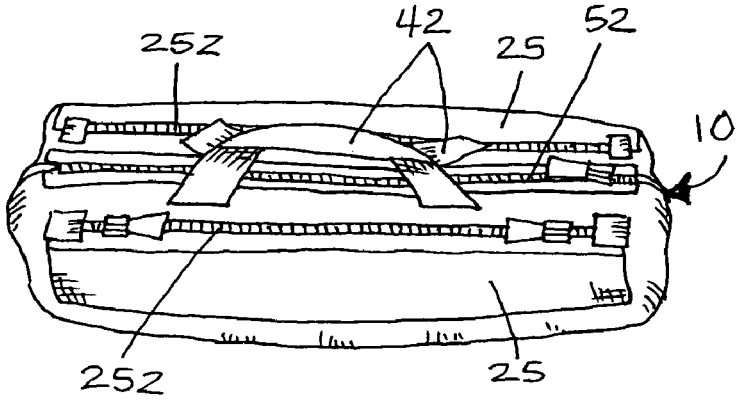
FIG. 9 is a top view of a fully folded bag of FIG. 7 enclosed and with the carrying handles on top.
Figure 10:
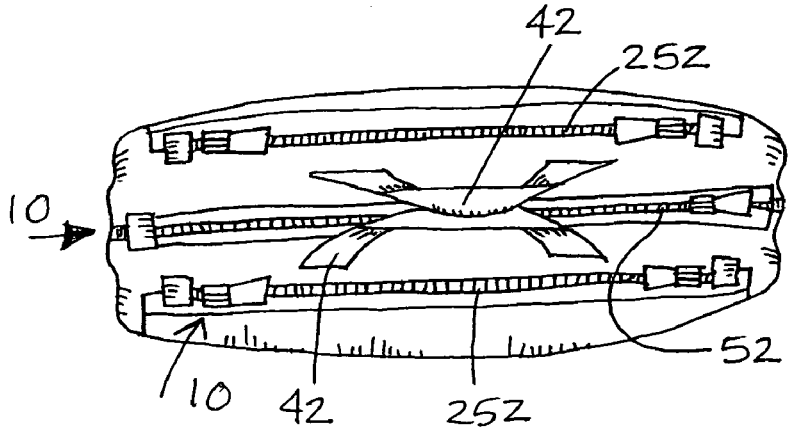
FIG. 10 is a top view similar to FIG. 9 but with the bag reversed end for end.

The bag 10 can then also be folded along the center line indicated at 50 which lies along the strap 16, and the bag would be formed to the configuration or form shown in FIG. 5 from the side and FIGS. 9 and 10 when looked at from the top. A second separate zipper 52 or other fastener can be provided along the edges of the center section 12A and as seen, the zipper 52 separates into section 52A and 52B, like a jacket zipper, when the bag is open as shown in FIG. 2. The zipper sections are joined and closed when the bag is in the format of FIGS. 5 and 8–10. The folded panel can be zipped closed to form a suitcase size and style bag with the end section folded in, and then carried with the handles 42 as previously shown. Items can be placed on the interior before the end sections are folded so they will be carried in the enclosed interior.

The separate shoe pockets 25 along the sides can be used for various storage, when closed as shown in FIGS. 4, 9 and 10. These side pockets can be used for clothes or accessories for travel.

The bag also has loops 14U for holding an umbrella 54 (See FIG. 4). These loops also are operable strap sections that can be held closed with hook and loop fasteners or snaps or similar releasable fasteners to open and close the loops.

SUMMARY

The multipurpose Universal Carrying Bag stores or travels as a small tote style bag that transforms into a traveling carrying bag that stores various sports equipment for golf, baseball or softball. The bag easily and quickly converts into a mid-size, soft-sided game bag that functions as a golf bag that can hold all of a persons clubs and equipment for the practice range or a round of golf. It can be a baseball and softball bag for storing balls, bats and equipment for taking to the field to practice or for a game.

The Multipurpose Universal Carrying Bag, when fully folded, stores or travels as a medium sized carry-on, tote style bag with two large exterior pockets for storage as shown in FIG. 4 on opposite sides of the bag.

The fully folded, medium sized carry-on tote unzips from the top (between the two carrying handles) and completely unfolds into a two fabric layer panel that reveals several pockets and Velcro® loops for storing and securing golf balls, baseball, softballs, golf clubs, baseball and softball bats, water bottle, golf tees, golf gloves, baseball and softball gloves, towel, umbrella and accessories and other equipment. The bag also has sewn in metal rings for attaching a shoulder strap.

The two fabric layer rectangular panel has pockets and Velcro® loops for storage, folds in half, so that both full length longitudinal halves overlie each other and then zippers closed on three sides. The bag has two fabric handles on center at the top as well as a clip-on shoulder strap for carrying. The bag has the two large exterior pockets for storage on opposite sides of the bag. In this form the bag functions as a traveling carry-on bag.

The two-fabric layer panel when flipped over to is opposite side from the interior pockets and Velcro® loops reveals a durable fabric panel that has the two large exterior pockets for storage. The pockets are place on center and adjacent to each other or they can be one above the other. The left hand panel, with the metal snaps (top left and lower right) have the function of folding in towards the middle and securing into place by two additional compatible snaps. The securing snaps are revealed when the two large exterior pockets for storage on opposite sides of the bag are unzipped. Once the snaps are snapped in place, the fabric panel then folds in half so that both longitudinal halves overlie each other and then zippers closed on two sides. There is a Velcro® strip to secure the bag zipper in place. In this function the bag can be used as a mid-sized, soft-sided golf bag for carrying golf clubs, and any other accessories.

Although the present invention has been described with reference to preferred embodiments, workers skilled in the art will recognize that changes may be made in form and detail without departing from the spirit and scope of the invention.

What is claimed is:

1. A multipurpose bag comprising a flexible material panel having a perimeter, the flexible material panel being divided into a center section, a first end section and a second end section arranged in a series along a longitudinal direction, a fastener arrangement that closes along an edge of at least one end section of the flexible material panel and along a pair of opposite longitudinal side edges, so that upon folding the bag along a longitudinal dividing line the fastener arrangement can be closed along the edge of the at least one end section and a longitudinal side formed by the opposite longitudinal side edges, the at least one end section being foldable along a transverse line to overlie portions of the center section before the bag is folded along the longitudinal dividing line, the fastener arrangement being closeable when the bag is folded along the longitudinal dividing line to form an open top bag, and wherein the first and second end sections both are of size to fold over said center section before the bag is folded along the longitudinal dividing line, and the bag then being foldable along the longitudinal dividing line so that the opposite longitudinal side edges thereof mate, and a separate fastener along the opposite longitudinal edges of the center section only for holding the folded center section in a closed position with both of the end sections enclosed by the folded center section.

2. The multipurpose bag of claim 1, wherein a first side surface defined within the perimeter of the flexible material panel has pockets formed thereon for storing accessory items.

3. The multipurpose bag of claim 2, wherein the pockets comprise fasteners for closing at least some of the pockets provided.

4. The multipurpose bag of claim 1, wherein the at least one end section and the center section have fasteners thereon for holding the at least one end section in a folded condition.

5. The multipurpose bag of claim 1, including a reinforcing strip extending along a longitudinal center line of the flexible material, said strip being positioned so that it forms a closed edge of the bag when the fastener arrangement is closed.

6. The multipurpose bag of claim 1, wherein the fastener arrangement is a zipper that extends along ends and the longitudinal side edges of the flexible material panel.

7. The multipurpose bag of claim 6 and handle members formed on each of the opposite longitudinal side edges, said handle members aligning with each other when the bag is folded along the longitudinal dividing line and the zipper is used for joining the longitudinal side edges.

8. A multipurpose bag comprising a flexible material panel having a perimeter, the flexible material panel being divided into a center section, a first end section and a second end section arranged in a series along a longitudinal direction, a fastener arrangement that closes along an edge of at least one end section of the flexible material panel and along a pair of opposite longitudinal side edges, so that upon folding the bag along a longitudinal dividing line the fastener arrangement can be closed along the edge of the at least one end section and a longitudinal side formed by the opposite longitudinal side edges, the center section, and the first and second end sections are separated by transverse reinforcing separating strips extending transversely to the longitudinal dividing line, said transverse reinforcing strips having openable and closeable loops formed thereon for receiving elongated objects extending longitudinally along the multipurpose bag.

9. The multipurpose bag of claim 8, wherein said loops are positioned on the transverse reinforcing strips such that when the at least one end section is folded to overlie the center section at least some of the loops are on an interior of the bag when the bag is folded along its longitudinal dividing line and the fastener arrangement is used to close the bag along the longitudinal side.

10. The multipurpose bag of claim 8, wherein said longitudinal dividing line has a longitudinally extending reinforcing strip thereon, and a plurality of pockets of size to receive golf tees mounted on the longitudinally extending reinforcing strip.

11. The multipurpose bag of claim 10, wherein said longitudinally extending reinforcing strip has rings for supporting a shoulder strap thereon.

12. A multipurpose bag comprising a flexible fabric material panel having a perimeter, with a longitudinal length greater than a transverse width, the flexible fabric material panel being divided along transverse lines into a center section, a first end section and a second end section, said first and second end sections being arranged on opposite ends of the center section, said first and second end sections being foldable along the transverse lines, a first zipper for holding opposite longitudinal edges of the flexible fabric material panel in a joined position when the flexible fabric material panel is folded with both of the first and second end sections extending from the opposite ends of the center section, and when selectively one or both of the first and second end sections are folded to overlie the center section, and a second separable zipper having zipper sections along opposite edges of the center section and joinable when both the first and second end sections are folded to overlie the center section.

13. The multipurpose bag of claim 12 and pockets on the surface of the bag that is on an exterior when the bag is folded in at least one direction of folding along a longitudinal dividing line.

14. The multipurpose bag of claim 12, wherein said bag forms an open top bag when one of the first and second end sections is folded to overlie the center section, and the flexible fabric material panel is folded along a longitudinal dividing line.

* * * * *